US005990465A

United States Patent [19]

Nakaoka et al.

[11] Patent Number: 5,990,465

[45] Date of Patent: Nov. 23, 1999

[54] ELECTROMAGNETIC INDUCTION-HEATED FLUID ENERGY CONVERSION PROCESSING APPLIANCE

[75] Inventors: Mutsuo Nakaoka, Nishinomiya; Yasuzo Kawamura; Yoshitaka Uchihori, both of Ibaraki, all of Japan

[73] Assignee: Omron Corporation, Japan

[21] Appl. No.: 08/489,087

[22] Filed: Jun. 9, 1995

[30] Foreign Application Priority Data

Mar. 27, 1995 [JP] Japan ..... 7-094345

[51] Int. Cl.[6] ..... H05B 6/08; H05B 6/10

[52] U.S. Cl. ..... 219/629; 219/630; 219/661; 219/667; 219/674

[58] Field of Search ..... 219/628, 629, 219/630, 661, 665, 667, 672, 674

[56] References Cited

U.S. PATENT DOCUMENTS

| | | | |
|---|---|---|---|
| 4,089,176 | 5/1978 | Ashe | 219/628 |
| 4,341,936 | 7/1982 | Virgin | 219/629 |
| 4,560,849 | 12/1985 | Migliori et al. | 219/667 |
| 4,845,332 | 7/1989 | Jancosek et al. | 219/667 |
| 5,055,648 | 10/1991 | Iceland et al. | 219/667 |
| 5,450,305 | 9/1995 | Boys et al. | 219/624 |
| 5,504,309 | 4/1996 | Geissler | 219/663 |

FOREIGN PATENT DOCUMENTS

| | | | |
|---|---|---|---|
| 2 565 059 | 11/1985 | France | 219/630 |
| 53-158970 | 12/1978 | Japan . | |
| 58-44473 | 3/1983 | Japan . | |
| 58-98701 | 6/1983 | Japan . | |
| 59-161774 | 7/1984 | Japan . | |
| 60-115949 | 5/1985 | Japan . | |
| 60-184005 | 8/1985 | Japan . | |
| 60-197412 | 9/1985 | Japan . | |
| 62-216221 | 8/1987 | Japan . | |
| 2-23158 | 1/1990 | Japan . | |
| 2-61066 | 3/1990 | Japan . | |
| 2-94130 | 9/1990 | Japan . | |
| 2-97097 | 9/1990 | Japan . | |
| 3-98286 | 4/1991 | Japan . | |
| 4-92801 | 3/1992 | Japan . | |

OTHER PUBLICATIONS

Uchihori et al., "The State–of–the Art Electromagnetic Induction Flow–Through Pipeline Package Type Fluid Heating Appliance . . . " International Power Electronics Conference, Apr. 3–7, 1995.

SPC–94–36–44 (Japanese Language Reference) Published Jun. 10, 1994.

*Primary Examiner*—Philip H. Leung

*Attorney, Agent, or Firm*—Morrison & Foerster, LLP

[57] ABSTRACT

This invention pertains to an electromagnetic induction fluid heating apparatus equipped with a heating element constructed from a conductive material installed in a fluid flow passage, a coil installed around this heating element, and a high frequency electrical current generator for this coil. In particular, this heating element is a layered component that allows electrical conduction between metallic plates. This heating element is formed so that electrical current vortices occur throughout this layered component. By forming a fluid flow passage that allows mixing within this layered component, the electrical power efficiency becomes 100%. Moreover, this high frequency electrical current generator is an invertor that uses semiconductor power devices such as SIT, B-SIT, MOSFET, IGRT, and MCT, etc. When the preferred PWM system (Pulse Width Modulation) is used, the heating efficiency (affected by the efficiency of the invertor, etc. matched with this layered component) exceeds 90%.

19 Claims, 18 Drawing Sheets

New induction-heated electrical energy conversion & utilization system

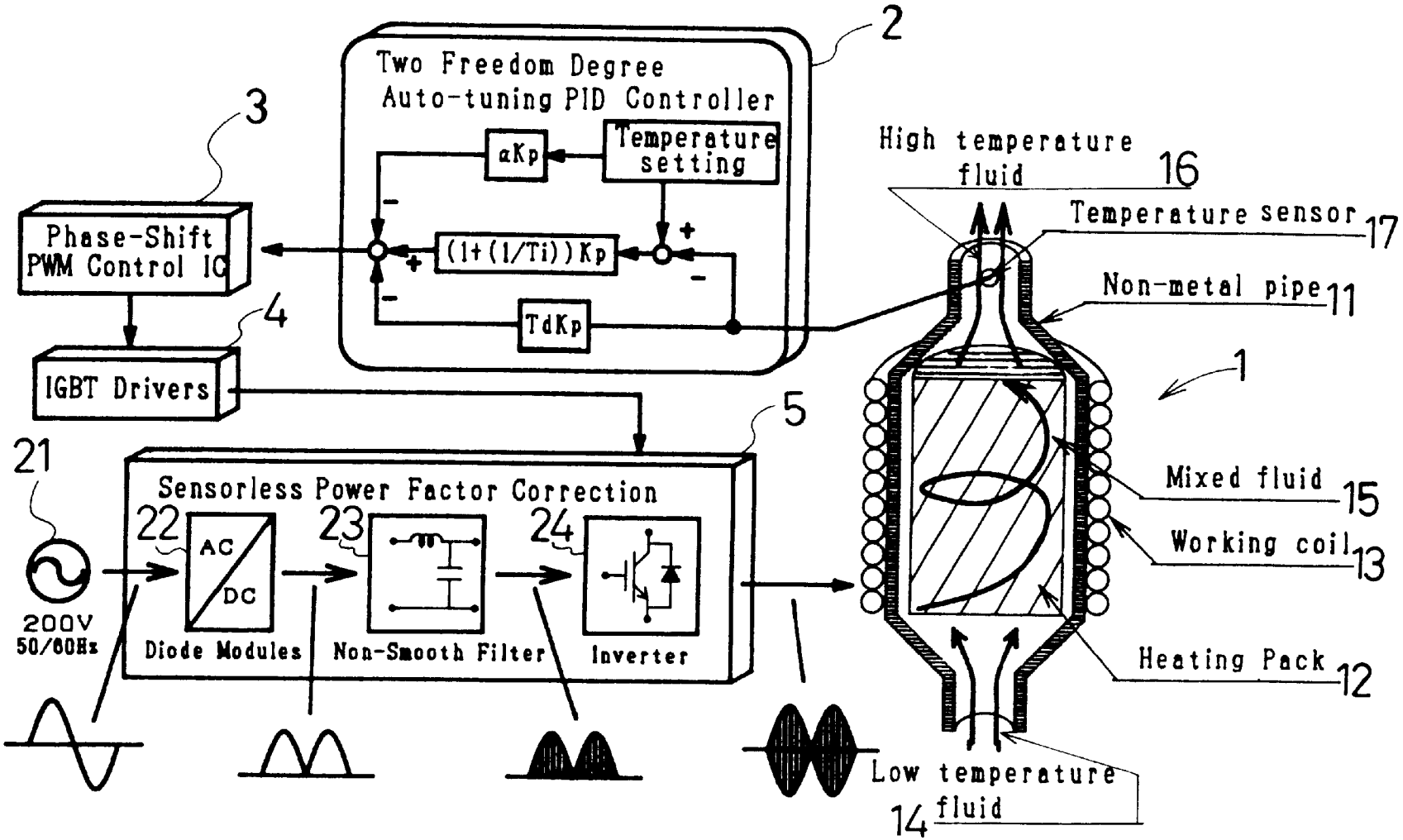
Fig.1 New induction-heated electrical energy conversion & utilization system Special-designed metal layer packing for Fluid through Heating Pack as eddy-current heated body by Induction heating principle

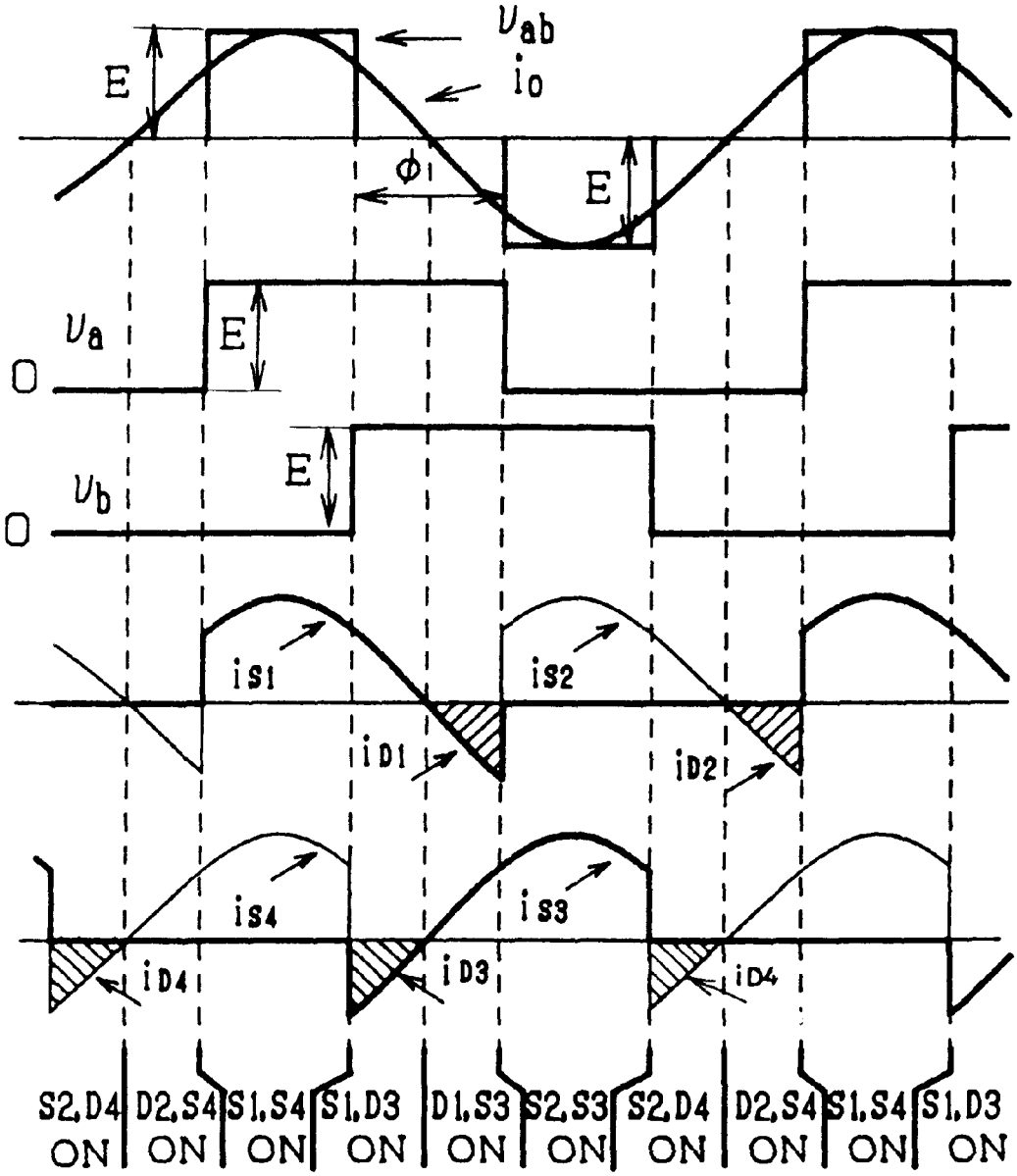
Fig. 4 Voltage and current waveform

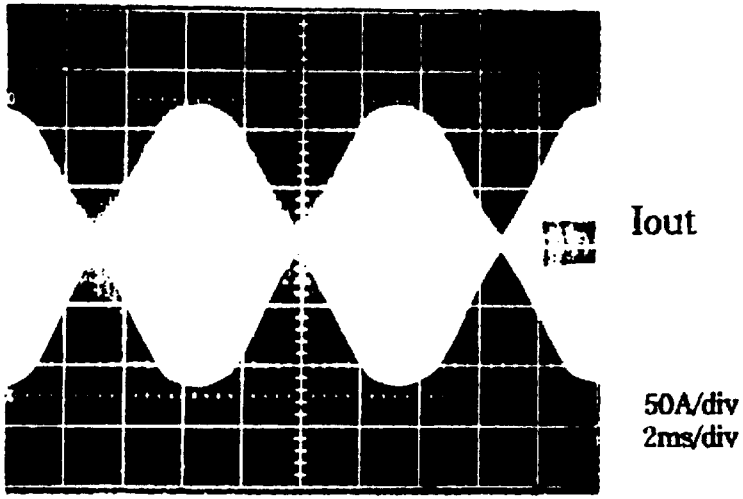
Fig. 6 Outpur current waveform
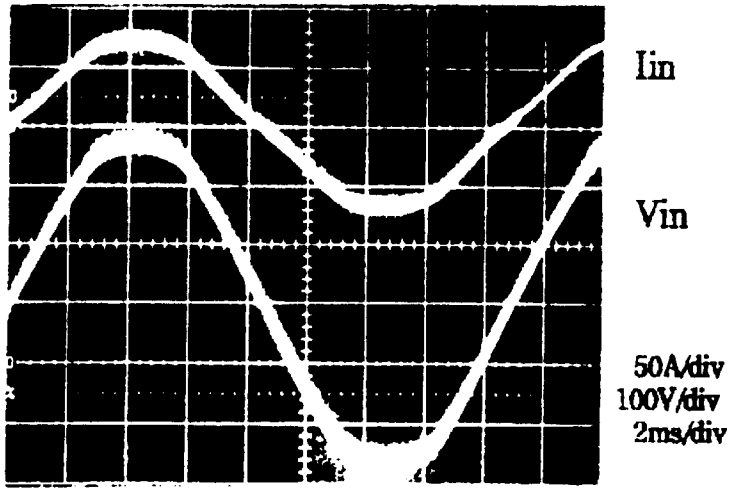
Fig. 5 Input voltage and current waveforms

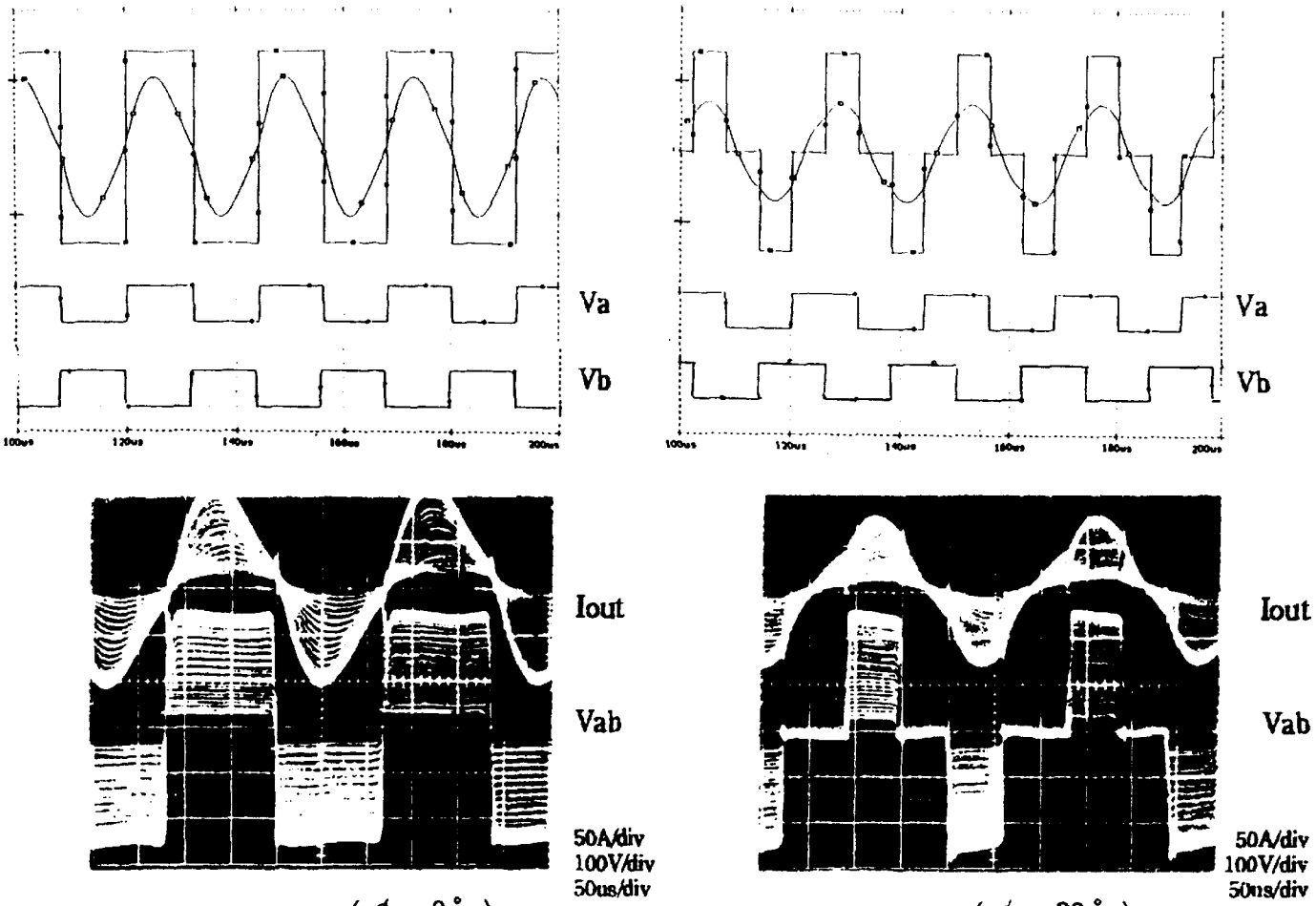
Fig. 7(a) at full power
Fig. 7(b) at half power
Output voltage and current waveforms with High-frequency carrier Table 1 Design specifications of inverter-fed induction-heating fluid heating appliance

| Items | Design Specifications |
|---|---|
| Input AC Voltage | Single-Phase 200V Rms |
| Regulated Output Power Range | 0 ~ 10KW ( Continuous ) |
| Power Regulation Strategy | Constant-Frequency Phase-Shifted PWM ( Micro Linear : ML4818 ) |
| Operating Frequency | 30KHz |
| Size of Heating Pack | ¢ 100mm × ℓ 190mm |
| Temperature Control System | Two Freedom degree Auto-tuning PID Controller |
| Remark | Without matching transformer for high-frequency |

Fig. 8

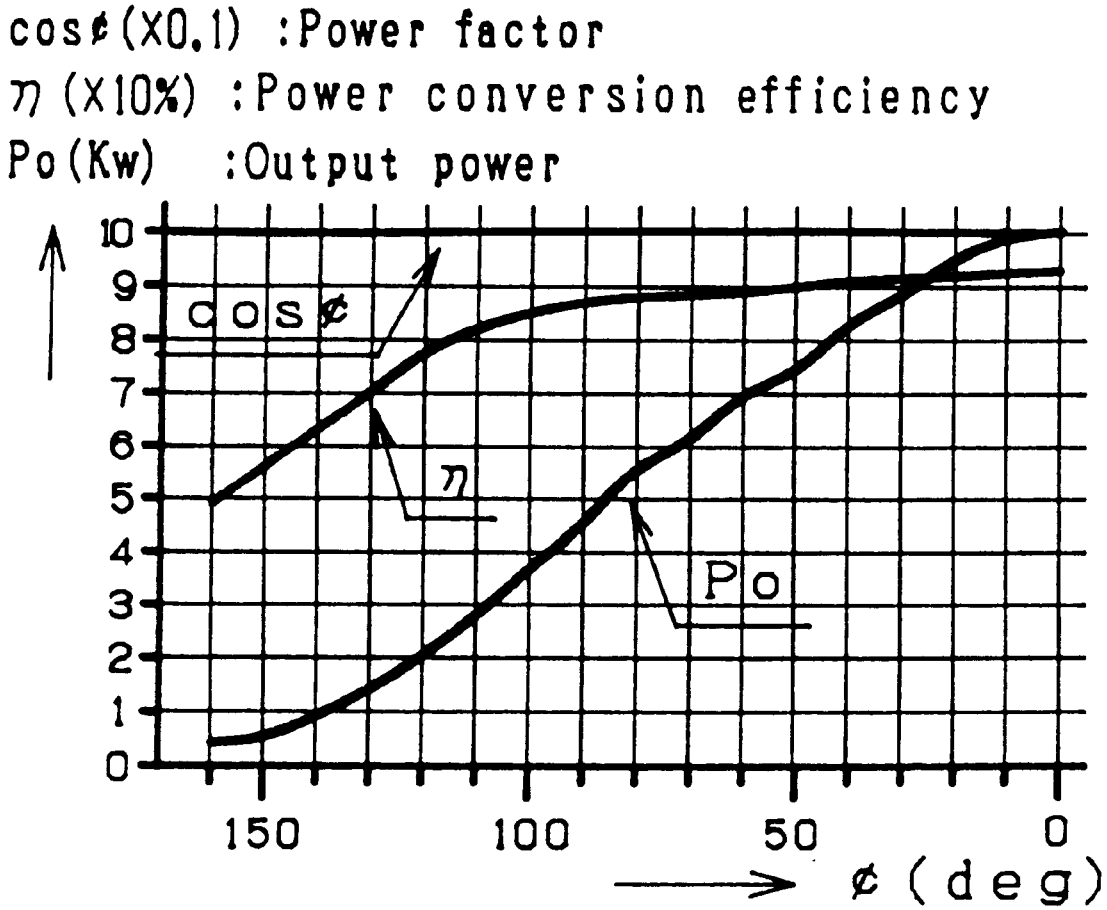
Fig. 9 Steady-state characteristics of this inverter system

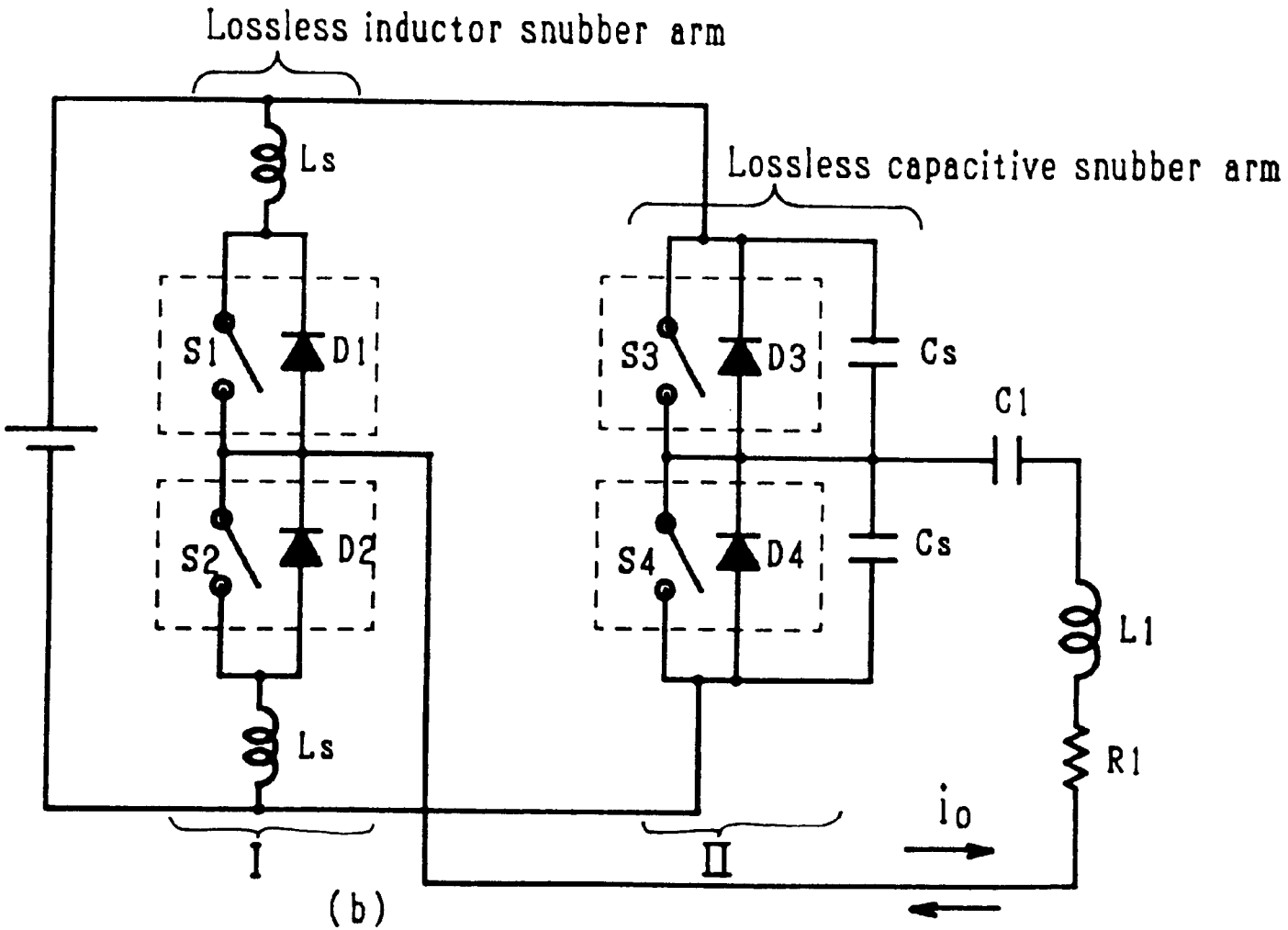
(b)
Fig. 10A Voltage-fed full-bridge type series load resonant inverter

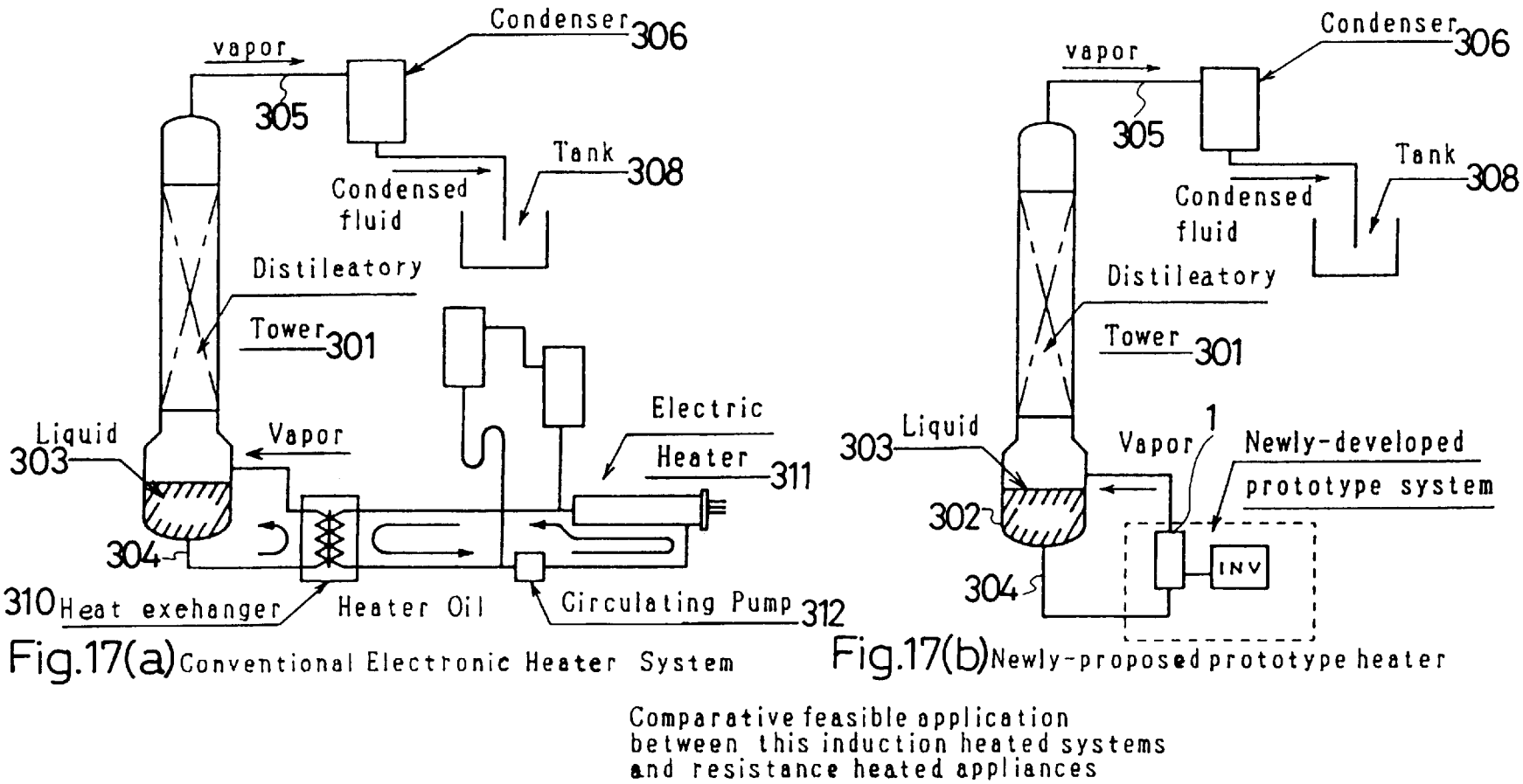
Fig.17(a) Conventional Electronic Heater System
Fig.17(b) Newly-proposed prototype heater
Comparative feasible application between this induction heated systems and resistance heated appliances

ELECTROMAGNETIC INDUCTION-HEATED FLUID ENERGY CONVERSION PROCESSING APPLIANCE

TECHNICAL FIELD OF THE INVENTION

This invention pertains to an electromagnetic induction fluid heating apparatus that is capable of continuous, direct, uniform, rapid, and efficient heating of a fluid such as a liquid, gas, etc. by the use of electromagnetic induction.

BACKGROUND OF THE INVENTION

Although electromagnetic induction heating is widely utilized in fields such as heat treatment, surface treatment, and melting, etc. metal processing, this type of heating has also been used in recent years for the continuous heating of fluids such as gases, liquids, etc.

A method has been proposed for electromagnetic induction heating of a fluid by heating a round metallic rod using an electromagnetic induction heating coil. The circular rod is mainly heated by the surface wave effect so that the outer periphery of the circular rod is heated. A fluid is made to flow at the periphery of the circular rod along the rod length axis. The fluid flows within this apparatus through a flow passage (circular rod) that is heated by electromagnetic induction heating, thereby indirectly heating the fluid. This method is deficient in that the overall heating efficiency is largely determined by the efficiency of heat transfer between the flow passage and the fluid.

It is therefore proposed that a metallic heating element be inserted into a flow passage that is constructed from a non-electrically conductive material, and that this metallic heating element be heated by electromagnetic induction. This proposed apparatus utilizes the direct heating method to raise the heating efficiency. For example, it has been proposed that a star-shaped heating element be placed within the fluid flow passage, and that a heating coil surround the perimeter of the fluid flow passage. A starshaped heating element is used since the heat transfer surface area is increased, and since the surface greatly increases that is heated by the surface wave effect. However, starshaped heating element surface area heating is limited, thereby resulting in a limitation upon the degree of improvement of heating efficiency.

Therefore the same inventors have proposed a great increase in the heat transfer surface area, the area that is both heated by electromagnetic induction and that serves as the heat exchange surface. Specifically, a heating element is contained within a fluid flow passage. This heating element is a layered component, consisting of many metallic plates, constructed so as to be electrically conductive. Electrical current vortices occur throughout the metallic plates that comprise the layered component. Since the metallic plates are electrically in contact with one another, the central region is more readily heated than the layered component peripheral region. This results in a method to enhance the electromagnetic heating surface wave effect. Per this heating method, the surface area of the layered component is greatly increased, and the efficiency of heat transfer from the heating element to the fluid in raised by nearly 100%. It becomes possible to create conditions for ready control of temperature.

Moreover, turbulent flow and mixing of the fluid are made to occur within the fluid flow passage within the layered component (the above-mentioned heating element). This therefore assures that the fluid within the layered component is uniformly heated. In contrast, a heating element is also proposed that causes a controlled flow through a fluid flow passage other than through this layered component.

However, by the use (as a heating element) of a layered component that has a fluid flow passage that causes mixing and turbulent flow within the fluid, heat transfer efficiency was greatly improved between the heating element and the fluid. It then becomes necessary to improve the efficiency of electrical power transfer to this heating element. In other words, the advantages of a layered component heating element began to appear upon combination of this type of heating element with an efficient high frequency electrical current generator. The electromagnetic induction fluid heating apparatus was realized.

Therefore the goal of this invention is to provide an advantageous combination of a high frequency electrical current generator and a layered component heating element.

SUMMARY OF THE INVENTION

This invention is an electromagnetic induction fluid heating apparatus that includes several components. A heating element is constructed from electrically conductive material. A coil is provided surrounding this heating element. A high frequency electrical current generator is provided for this coil.

This heating element is a layered component that consists of metallic plates that are stacked so as to be capable of electrical connection between each other. This heating element is constructed so that electrical current vortices are formed throughout nearly the entire layered component. A fluid flow passage is formed within this layered component.

This high frequency electrical current generator has an invertor that outputs high frequency electrical current by the opening/closing action of semiconductor power devices.

Moreover, the semiconductor power devices consist of four individual semiconductor power devices making up a full bridge. Among these four semiconductor power devices, two of the semiconductor power devices are for generating standard phase pulses, and the remainder are for generating control phase pulses. A phase-shift control component is provided that changes the phase difference between this standard phase pulse and this control phase pulse.

Also, it is preferred that this phase-shift control component be operated based upon a temperature controller that is connected to a temperature sensor for the fluid. This temperature control component is a PID controller that has at least two degrees of freedom.

Moreover, this semiconductor power device is at least one type of semiconductor power device selected from among the follow group of devices: SIT, B-SIT, MOSFET, IGBT, and MCT.

Also, this high frequency electrical current generator includes a resonance condenser that is connected in series to this coil.

In other words, this invertor utilizes SIT, B-SIT, MOSFET, IGBT, MCT, etc. semiconductor power devices. It is preferred that an invertor (utilizing the PWM, Pulse Width Modulation method) be combined with a heating element (that consists of metallic plates stacked together so as to be mutually electrically conductive, and that contains a fluid flow passage), to that thermal efficiency (determined by the efficiency of the invertor, etc.) exceeds 90%. An apparatus becomes practical that makes temperature control possible.

Moreover, the thickness of the above-mentioned metallic plate is greater than 30 microns. The high frequency of the above-mentioned high frequency electrical current generator is within the range of 15–150 kHz.

Moreover, the heat transfer area per cubic centimeter of the this layered component is greater than 2.5 square centimeters. The quantity of fluid that is heated by one square centimeter of this layered component heat transfer area is less than 0.1 cubic centimeter.

In other words, high heating efficiency is maintained by an appropriate heat transfer area of the layered component and by an appropriate thickness, etc. of the metallic plates that comprise the layered component. Heating responsiveness is prolonged. Temperature unevenness is reduced. Temperature control is readily carried out. It becomes possible to widen the range of temperatures obtained by heating.

Moreover, the layered component is comprised of metallic plates that are stacked together so that electrical contact is possible between the plates. This heating element is formed with a fluid flow passage through the above-mentioned layered component. This fluid heating method heats fluid by the use of a coil that is provided at the perimeter of this heating element.

The on-off operation of a semiconductor power device causes high frequency waves of electrical current to flow through this coil. This heating method heats the fluid that flows through the above-mentioned fluid flow passage. This heating is carried out by causing this heating element to heat due to the generation of electrical current vortices in nearly all of the layered component.

BRIEF DESCRIPTION OF THE DRAWING

FIG. 1 is a mechanical block diagram that shows a novel electromagnetic induction fluid heating apparatus.

FIG. 2 (*a*) is a tilted perspective diagram. FIG. 2 (*b*) is an photograph of the actual object. FIG. 2 (*c*) is a partial expanded view. FIG. 2 (*d*) is a diagram that shows the heat distribution.

In addition, FIG. 3 (*a*) and FIG. 3 (*b*) are mechanical block diagrams showing the high frequency electrical current generator. FIG. 3 (*b*) shows the high frequency invertor portion of the circuit.

FIG. 4 is a plot of the simulation waveforms.

FIG. 5 is a plot showing the input voltage and the input current waveforms.

FIG. 6 is a plot of the output current waveforms.

FIG. 7 (*a*) and FIG. 7 (*b*) are plots of the waveforms of the output voltage and the output current. FIG. 7 (*a*) shows the case of full power. FIG. 7 (*b*) shows the case of half power.

FIG. 8 shows the specifications of the high frequency electrical current generator.

FIG. 9 is a graph that shows the efficiency of the high frequency electrical current generator of FIG. 8.

FIG. 10 is a diagram showing another high frequency electrical current generator.

FIG. 17 (*a*) and FIG. 17 (*b*) are mechanical block diagrams showing an example of a common application of the electromagnetic induction fluid heating apparatus. FIG. 17 (*a*) shows a prior art example that utilizes an electrical heater and a heat exchanger. FIG. 17 (*b*) shows an example of this invention.

DESCRIPTION OF THE PREFERRED EMBODIMENTS

Figure 2B:
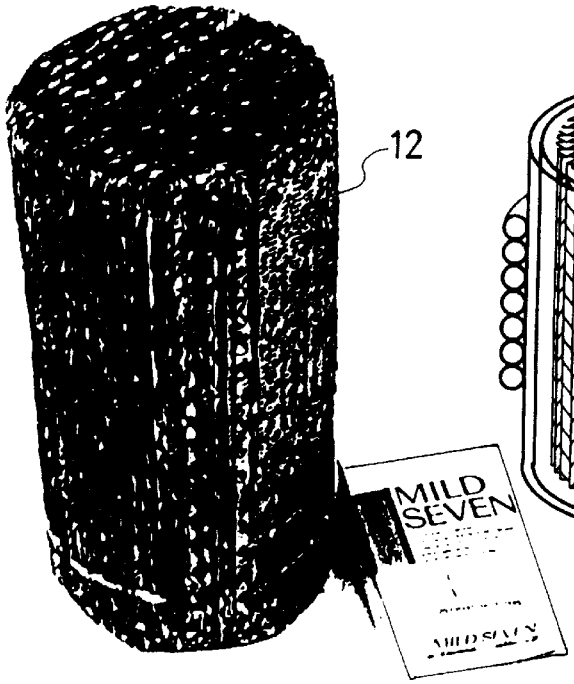
FIG. 2 (*a*) through FIG. 2 (*d*) show the structure of the heating element that is combined with the apparatus.
Figure 2A:
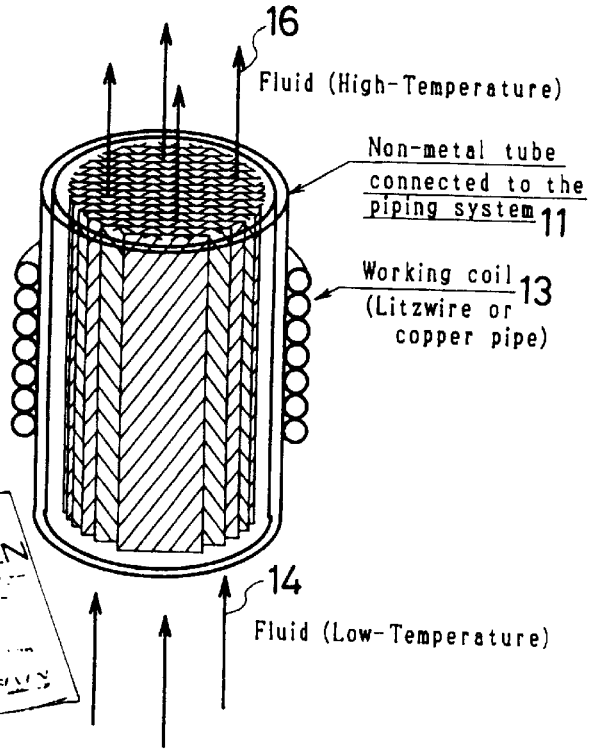
Figure 2C:
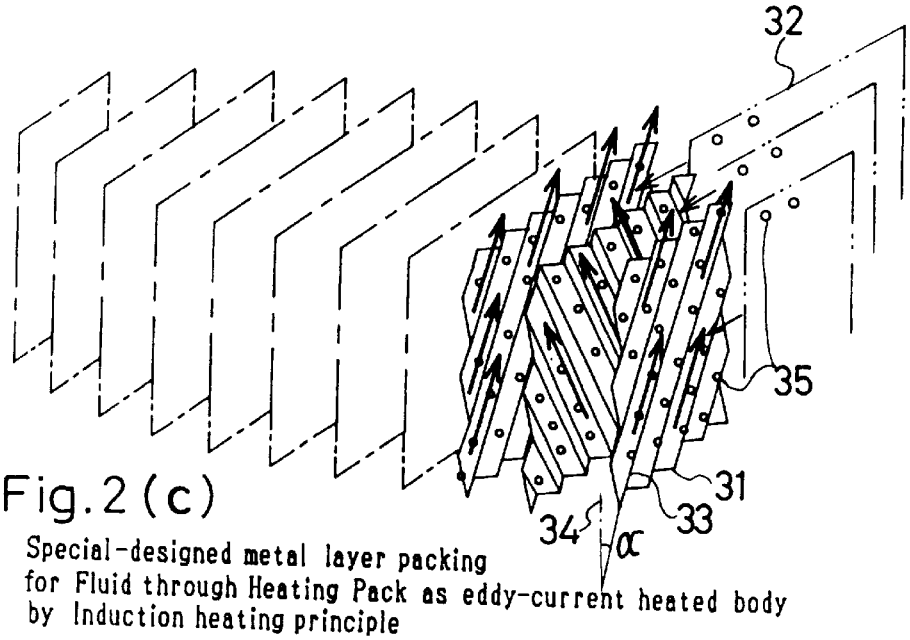
Figure 2D:
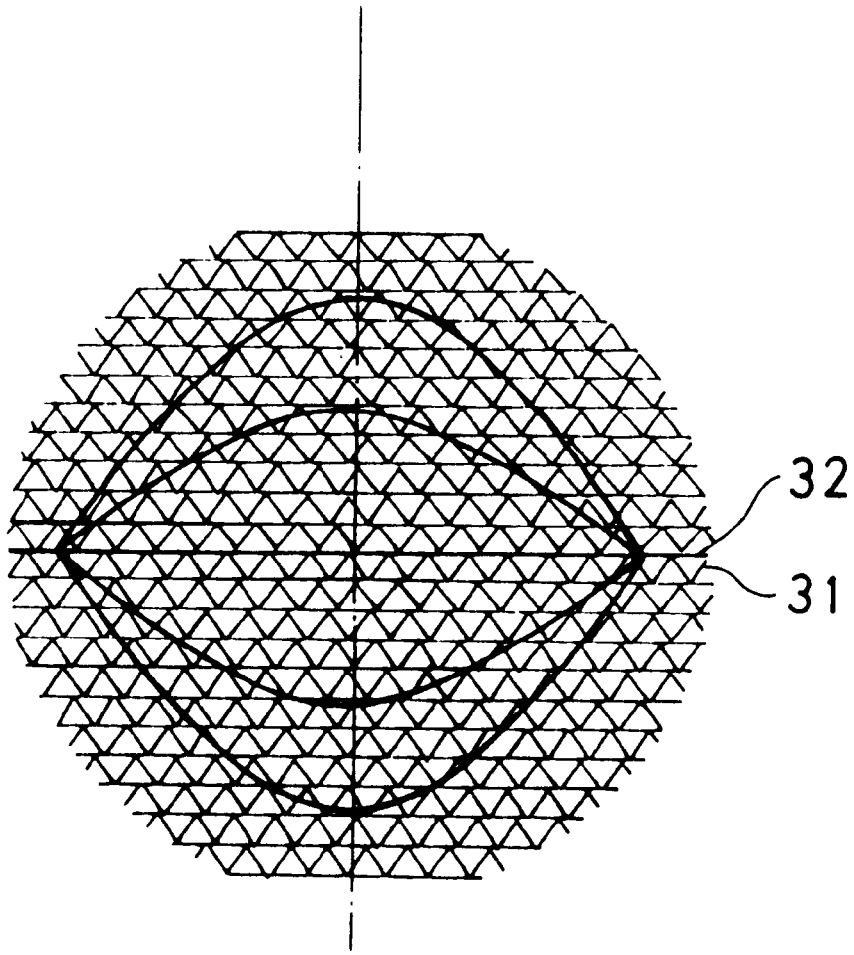

This invention will be explained in detail while the attached illustrations are referred to. FIG. 1 is a mechanical block diagram that shows the electromagnetic induction fluid heating apparatus. This shows an electromagnetic induction fluid heating apparatus that consists of a primary apparatus 1, PID temperature controller 2 with two degrees of freedom, a phase shift controller 3, a gate driver 4, and a sensorless high power high frequency invertor 5.

The primary apparatus 1 includes a non-metallic pipe 11 that forms the fluid flow passage. This non-metallic pipe 11 contains heating element 11. Working coil 13 is wrapped around the outside of non-metallic pipe 11. After low temperature fluid 14 enters non-metallic pipe 11 from below, flows through the heating element 12 fluid flow passage, and becomes uniformly-heated mixed fluid 15, high temperature fluid 11 then flows out through the upper outlet of non-metallic pipe 11 . The temperature of this high temperature fluid is detected by temperature sensor 17. Temperature sensor 17 is connected to temperature controller 2.

High frequency invertor 5 consists of alternating current power supply 21, diode module 22, non-smooth filter 23, and high frequency invertor 24. The output power and frequency of high frequency invertor 24 are controlled by phase shift controller 3 and gate driver 4. Electrical energy is used effectively due to the efficient conversion of commercial alternating current power supply 21 into high frequency electrical current.

Temperature controller 2 is constructed using a Fuji 1 auto-tuning PID temperature controller with two degrees of freedom. The output voltage signal is sent to phase shift controller 3. In this manner, since the output controller temperature sensor 17 in provided at the outlet of non-metallic pipe 11, it becomes possible to control output temperature while simultaneously compensating for invertor 5 and coil 13 losses.

FIG. 2 (*a*) through FIG. 2 (*d*) show the structure of the heating element 12 that is combined with the primary apparatus 1. FIG. 2 (*a*) is a tilted perspective diagram. FIG. 2 (*b*) is an actual photograph. FIG. 2 (*c*) is an expanded partial view. FIG. 2 (*d*) is a diagram that shows the heat distribution. Heating element 12 is constructed by alternating stacking of corrugated no. 1 metallic plate 31 and flat no. 2 metallic plate 32, thereby forming the cylindrical tube-shaped layered component. SUS4431 Martensite-type stainless is used as the material of construction of this no. 1 metallic plate 31 and no. 2 metallic plate 32. The ridges 33 (and troughs) of the no. 1 metallic plate 31 form an angle $\alpha$ with respect to central axis 31. Adjacent no. 1 metallic plates 31 are placed aligned so the ridges 33 (or troughs) of the no. 1 metallic plate 31 (contacting through no. 2 metallic plate 32) intersect one another. The no. 1 metallic plate 31 is spot welded to the no. 2 metallic plate 32 at the ridges 33 (or troughs) intersection points of the no. 1 metallic plates 31, thereby making possible the electrical current transmission. Apertures 35 are provided within the no. 1 metallic plate 31 and the no. 2 metallic plate 32 surfaces, thereby causing turbulent flow of the fluid. When high frequency electrical current flows through working coil 13 so that a high frequency magnetic field is applied to the layered component (heating element 12), electrical current vortices arise throughout no. 1 metallic plate 31 and no. 2 metallic plate 32. The heating element 12 layered component gives off heat. The temperature distribution is as shown in FIG. 2 (*d*). This results in a bulls-eye type distribution that stenches along the length direction of the no. 1 metallic plate 31 and no. 2 metallic plate 32. Since the central region generates more heat than the peripheral region, this heating element is used with advantage for fluid heating. Moreover, a complex fluid flow passage is formed within the heating element 12 layered component so that the fluid is mixed, agitated, and uniformly heated.

Working coil 13 is soldered together using litz wire. This working coil 13 is either wrapped around the outside perimeter of non-metallic pipe 11, or alternatively, coil 13 is wrapped around non-metallic pipe 11 buried within the wall of non-metallic pipe 11. Non-metallic pipe 11 supports working coil 13. Non-metallic pipe 11 forms the boundary of the fluid flow passage. Since heating element 12 is contained within this fluid flow passage, this non-metallic pipe 11 is constructed from non-magnetic material that is fusion-resistant, heat resistant, and pressure resistant. Specifically, although ceramic, etc. non-organic materials, FRP (Fiber Reinforced Plastic), fluorine-containing resin material, and non-magnetic metals such as stainless, etc. are used, ceramic material is most preferred.

Figure 3A:
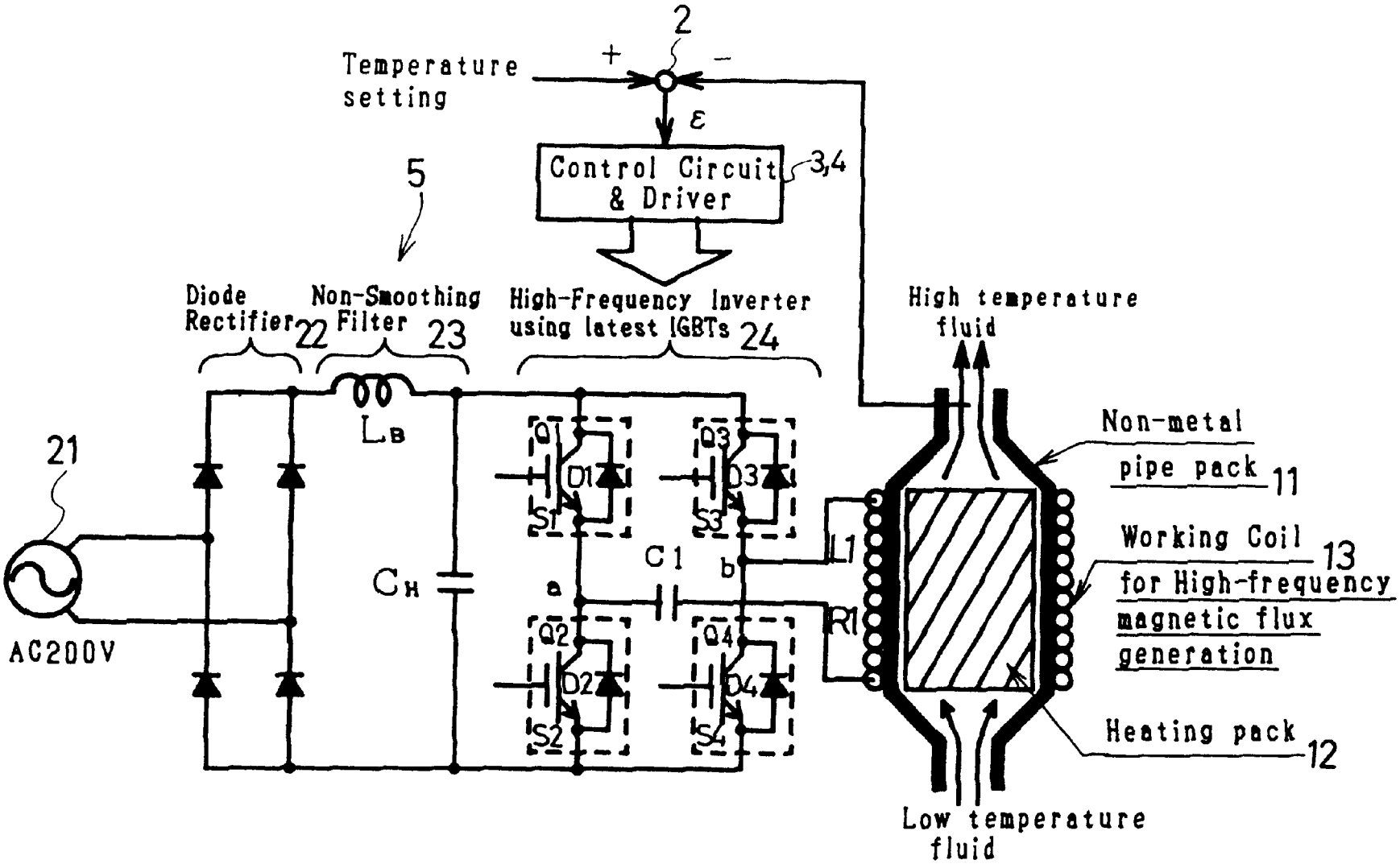
FIG. 3 (*a*) shows the electrical circuit of the high frequency electrical current generator.
Figure 3:
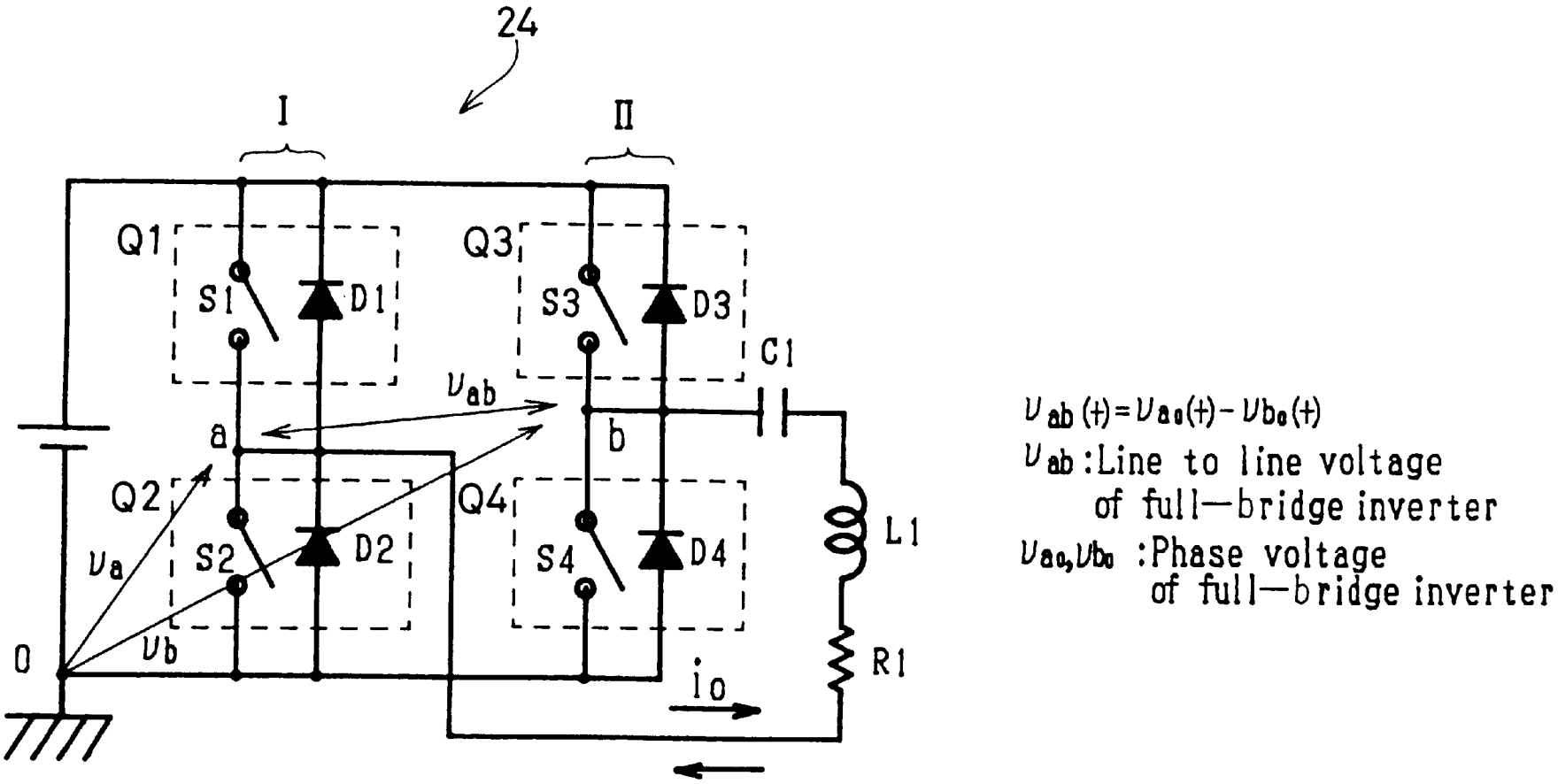

FIG. 3 (*a*) shows the electrical circuit of the high frequency electrical current generator 5. FIG. 3 (*b*) shows the high frequency invertor 24 circuit. The heating system includes a conductive metallic heating element 12 non-metallic pipe 11 and working coil 13 (that wraps around non-metallic pipe 11). As can be expressed per a high leakage inductance trans-circuit model, representation is possible as a simple R-L circuit constructed with a L1 and a R1. This R can be taken as the nearly fixed non-time-dependent circuit constant that is seen upon connecting this R-L circuit in series with a compensating condenser C1. Therefore, due to compensating condenser C1, the R-L load system L component can be readily compensated.

High frequency invertor 24 utilizes four switching elements Q1–Q4 in a full-bridge structure. Q1 and Q2 are connected directly in series. Q3 and Q4 are connected directly in series. These pairs of switching elements are connected in parallel. Each one of these switching elements Q1–Q4 is a circuit shown as a connected (in parallel) switch S1–S4 and diode D1–D4. Such a switching element is formed using semiconductor devices such as a SIT (Static Induction Transistor), R-SIT, MOSFET (Metal Oxide Semiconductor FET), IGBT, MCT, etc.

It is possible to use various embodiments of the high frequency invertor 24 circuit, such as a (not shown in FIG. 3 (*b*)) single semiconductor power device or a half-bridge configuration of a pair of semiconductor power devices.

When switches S1, S4 are closed, electrical current flows from point A, through L1/R1, and to point B. When switches S2, S3 are closed, electrical current flows from point B, through L1/R1, and to point A. In other words, from the viewpoint of L1/R1, electric current flows forward and backward. Each switch S 1–S4 is operated by a respective sub-50% dual cycle voltage pulse. The switch S1, S2 voltage driving pulse is used as a standard phase pulse. The switch S3, S4 voltage driving pulse is used as a control phase pulse. The phase angle between the standard phase and control phase voltage driving pulses can be continuously varied between 0° and 180°, thereby making possible control of the output voltage by PWM (Pulse Width Modulation). It is theoretically possible to continuously vary the output electrical power from 0 to a maximum output determined by both the circuit loading constant and the invertor operational frequency.

FIG. 4 shows a waveform simulation of the trans-circuit module phase difference controller output voltage $V_{ab}$ and output current $I_o$ During the time interval when switches S 1, S4 are on, the E output voltage $V_{ab}$ is positive. Positive electric current iS1, iS4 flows through switches S1, S4. During the time interval when switch S1 and diode D3 are on, the output voltage is zero, and positive current iD3 flows through diode D3. Also during the time interval when diode D1 and switch S3 are on, the output voltage is zero, and a negative current iD1 flows through diode D1. During the time interval when switches S2, S3 are on, the E output voltage $V_{ab}$ is negative. Negative electrical current iS2, iS3 flows through switches S2, S3. During the time interval when switch S2 and diode D4 are on, the output voltage is zero, and negative current iD4 flows through diode D4. Also during the time interval when diode D2 and switch S4 are on, the output voltage is zero, and a positive current iD2 flows through diode D2. These electrical currents iS1–iS4, iD1–iD4 are combined to obtain the illustrated sine-curve output current i0.

As an oscillograph, FIG. 5 shows the actual input voltage Vin and input current Iin of the high frequency electrical current generator 5. FIG. 6 shows the actual output current Iout as an oscillograph display. The entirely white areas are curves formed by alternating electric current. FIG. 7 shows the theoretical values of the output electrical current Iout and output voltage $V_{ab}$ along an expanded time scale. For comparison purposes, the equivalent actual oscillograph results are also displayed. FIG. 7 (*a*) shows the results at full power. FIG. 7 (*b*) shows the results at half power. Judging from FIG. 5 through FIG. 7, the output waveforms are in agreement with the FIG. 4 simulation waveforms.

FIG. 9 shows the efficiency of the high frequency electrical current generator 5 of FIG. 3. The device specifications for the high frequency electrical current generator 5 are shown in FIG. 8. With a phase difference Q is the range of 0°–60°, the output is within the range of 7.5–10 kW. The efficiency is high, greater than 90%. At 10 kW 100% output, the maximum efficiency is 93°/0. In other words, by the combination of a high power efficiency circuit (PWM method invertor utilizing a FIG. 3 IGBT type semiconductor power device) with a FIG. 2 type heating element (capable of nearly 100% heat transfer), an electromagnetic induction fluid heating apparatus is realized that has a high efficiency that surpasses the prior art.

However, per the FIG. 3 (*b*) circuit diagram and the FIG. 4 simulation waveform plot, when the phase difference+is non-zero, the S1, S2 bridge arm I always is in the leading current phase. It may also be understood that the S3, S4 bridge arm II is then always in the trailing current phase. Therefore when the bridge arm I switches S 1, S2 are at the turn on time period, there occurs ZVS (Zero Voltage Switching)/ZCS (Zero Current Switching). At the turn on time period, hard switching occurs. When the bridge arm II switches S3, S4 are at the turn on time period, there occurs ZVS/ZCS. At the turn off time period, hard switching occurs. When hard switching operation occurs at the bridge arm I turn on time period and at the bridge arm II turn off time period, noise and switching losses occur due to the direct electrical source short path phenomena due to opposing parallel diodes D1–D4.

Therefore it is preferred that a soft switching acceleration protective circuit be used, as shown in FIG. 10. Lossless inductors L3, L3 are added in series to arm I switches S1, S2. Lossless capacitors Cs, Cs are added in parallel with arm II switches S3, S4, thereby forming a phase shift PWM frequency control circuit.

Although the phase shift PWM method of power control has been explained, there are other methods, such as direct electrical current source control (PAM method) per an active PWM rectifier circuit and a high frequency transistor chopper, pulse-frequency modulation (PFM method), and the pulse duration (PDM method) using pulse cycle control. It is possible to combine a high power efficiency invertor with the FIG. 2 heating element, provided that this invertor outputs high frequency electrical current per the open-closed operation of a semiconductor power device, and that power control is possible for temperature adjustment.

Figure 11:
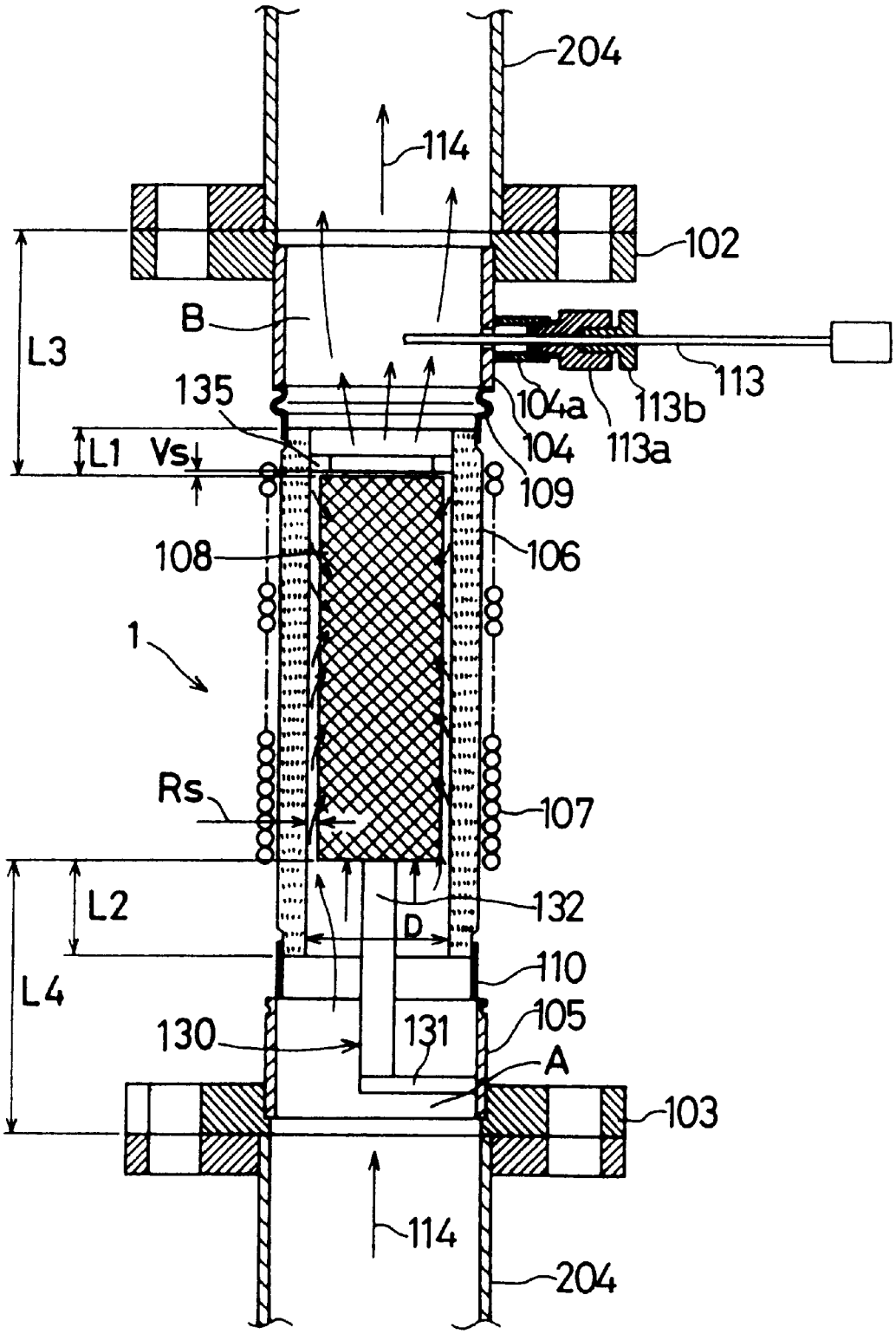
FIG. 11 is a cross-sectional diagram of the heating element.

FIG. 11 is a cross-sectional diagram showing an embodiment of primary apparatus 1. The major portion of primary apparatus 1 includes flanges 102, 103; short tubes 104, 105; pipe 106; coil 107; heating element 108; tubes 109, 110; support component 130; and ring-shaped retainer 135. If this is installed, for example, within in a chemical plant, etc. pipeline, fluid 11 flows upwards from the bottom.

The material of construction of flanges 102, 103 and short tubes 104,105 is an austenite-type stainless steel such as non-magnetic SUS316. Flange 102 and short tube 104 are combined by welding, etc. to form a tube-attached flange. Flange 103 and short tube 105 are combined by welding, etc. to form a tube-attached flange. Each of these flanges 103, 104 is attached to pipeline 204 by bolts, screws, etc. Socket 104*a*, constructed from the same SUS316, is fixed by welding to a position on short tube 104 at the fluid 114 outlet end B. Fitting 113*a* is screwed into socket 104*a* so as to hold temperature sensor 113. Insert 113 screws into fitting 113*a* so that the tip of temperature sensor 113 can be fixed near the center of short tube 104.

Pipe 106 is constructed from ceramic material. There is a large thermal expansion differential between pipe 106 and the austenite-type stainless steel of short tube 104, 105. Therefore within pipe 106 and between short tubes 104, 105 is provided connecting (via braising) tubes 109, 110. These tubes 109, 110 are constructed from a high-strength heat-resistant metal, such as a Fe—Ni—Co alloy, that has a thermal expansion coefficient that is intermediate between those of pipe 106 and short tubes 104,105.

Although tube 110 is straight, tube 109 is corrugated so that expansion/contraction is possible along the axial direction. The primary apparatus 1 utilizes heating element 10 to heat fluid 114. Thermal expansion stretches pipeline 204, as well as primary apparatus 1, along the axial direction. Therefore when primary apparatus 1 is connected together with pipeline 204 via flanges, there is concern that an unpredictable thermal stress can occur at the weakest portion of primary apparatus 1. Therefore corrugated tube 109 is provided to avoid thermal expansion within primary apparatus 1. This corrugated tube 109 also can possibly absorb misalignments (during production) of the pipeline 204 and primary apparatus 1 along the axial and radial directions. This corrugated pipe 109 can also be bent, thereby making possible the absorption of flanges 102, 103 parallelism misalignments.

During initial formation of heating element 108, heating element 108 has a diameter D so as to form a annular gap Rs between the heating element 108 outside surface and the pipe 106 inner wall. Support component 130 supports heating element 108 loosely at the center of pipe 106 so that heating element 108 and pipe 106 are concentric. The diameter D of heating element 108 is chosen such that annular gap Rs remains between the heating element and pipe 106 when fluid 114 is heated by primary apparatus 1. This annular gap Rs is greater than the axial thermal expansion differential between the pipe 106 and heating element 108. Support component 130 includes a metallic bar 131 that is attached (by welding, etc.) to the inlet end A of short tube 105. This metallic bar 131 extends in the radial direction. A non-magnetic support rod 132 is fixed to the tip of this metallic bar 131 so that the central axis of support rod 132 coincides with that of heating element 108. This support bar 132 is constructed from a ceramic, etc. material that is non-magnetic and that has both superior heat resistance and fusion resistance. This support rod 132 extends from the fluid inlet direction A toward the fluid outlet direction B. The tip of this support bar 132 holds and aligns heating element 108 relative to the position of coil 107. Item 135 is a ring-shaped retainer. This ring-shaped retainer 135 is constructed from a non-magnetic material that has superior heat resistance and fusion resistance. This ring-shaped retainer 135 fits into pipe 106 at the fluid 114 outlet side B. This ring-shaped retainer 135 is fixed within pipe 106 so that gap Vs is formed between heating element 108 and retainer 135 along the heating element 108 axial direction. This gap Vs is the same of somewhat smaller than the axial direction thermal expansion of heating element 108. This retainer 135 is positioned above heating element 108 cutting across annular gap Rs at the fluid outlet side B. Thermal expansion of heating element 108 results in sealing of annular gap Rs from the fluid outlet side B.

As fluid 114 flows through the primary apparatus 1 fluid inlet A toward fluid outlet B, electromagnetic induction (per coil 107 through pipe 106) causes fluid 114 to be heated by heating element 108. Although pipe 106 and heating element 108 simultaneously undergo differential thermal expansion in the radial direction, annular gap Rs shrinks so as to absorb the thermal expansion differential since this annular gap Rs is formed larger than the thermal expansion differential between pipe 106 and heating element 108. This prevents stresses generated by contacting/pushing of the heating element 108 against pipe 106. Although heating element 108 also undergoes thermal expansion in the axial direction, this thermal expansion is absorbed by the gap Vs formed between ring-shaped retainer 135 and heating element 108.

As this occurs, fluid 114 (flowing from pipeline 204 into heating element 108 from flow inlet side A) enters heating element 108 and is heated while flowing toward flow inlet side B. Also a portion of fluid 114 attempts to flow directly from the flow inlet side A, into annular gap Rs, then through annular gap Rs toward the flow inlet side B. Also a portion of fluid 114 attempts to flow from heating element 10, into annular gap Rs, and through annular gap Rs toward flow inlet side B. However, the axial direction thermal expansion of heating element 108 pushes against ring-shaped retainer 135 so that the fluid outlet side B of annular gap Rs is closed, preventing direct flow of fluid 114 toward the flow outlet side B. Therefore fluid 114, entering annular gap Rs from the flow inlet side A, generates pressure. After entering annular gap 114, fluid 114 can be forced by this pressure to flow into heating element 108.

By this means coil 107 heats heating element 108 by electromagnetic induction. Damage to pipe 106, caused by heat expansion of the heating element 108, can be prevented. Also, even though an annular gap Rs (for the purpose of absorbing the heat expansion of the heating element 108) is made, and even though the heating element expands due to heat so as to contact ring-shaped retainer 135, thus closing the outlet side B of the annular gap Rs, fluid 114 can consequently be made to flow from the annular gap Rs into heating element 108. This makes possible mixing and agitation of fluid 114 within heating element 108, thereby making possible uniform heating.

Now, although flanges 102 and 103 are austenite-type stainless steel, which is generally non-magnetic, because of their weight, they will undergo the effects of magnetic flux from coil 107, and gradually become heated in small increments. In order not to be affected by magnetic flux, it was determined by experimentation that when pipe 106 has an inner diameter that exceeds I 0 cm, it is necessary to separate L3 and L4 by more than 8 cm. Also, if the inner diameter is less than 10 cm, the separation must be more than this inner diameter times 0.8. Also by experimentation, it was determined that for pipe 109 and 110, if L1 and L2 exceed 5 cm, the effectiveness of the magnetic flux becomes problematic.

Next, using a specific primary apparatus 1 shown in FIG. 11, the effect of wave frequency, effect of thickness of the materials that make up the heating element, the effect of heat transfer area of the heating element, and the effect of the degree of layering upon the heat transfer area of the heating element were investigated.

Figure 12:
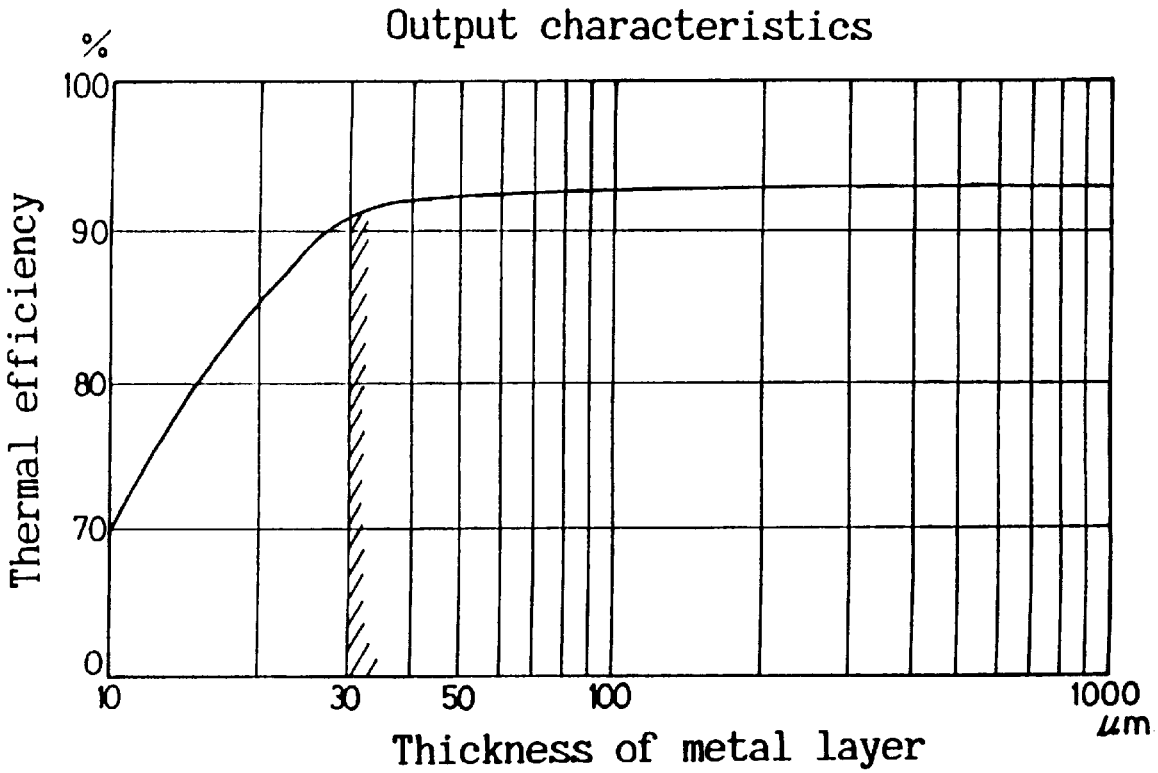
FIG. 12 through FIG. 14 are graphs that show the output characteristics of the heating element.

FIG. 12 indicates the relationship between plate thickness and the heating efficiency. A heating experiment was carried out in the frequency range of 20–40 kHz using a 10 cm diameter or 5 cm diameter heating element. The metallic plate thickness was varied around 50 microns. The overall heating efficiency was measured. Material of construction of the metal plate was SUS447J1. According to FIG. 12, when the metallic plate thickness exceeded 30 microns, the ascending rate of the heating efficiency rapidly decreases. Above 30 microns, the heating efficiency is approximately stable one at over 90%. Also, below 30 microns, it was found that thinner the metallic plate thickness resulted in a decreasing heating efficiency.

Figure 13:
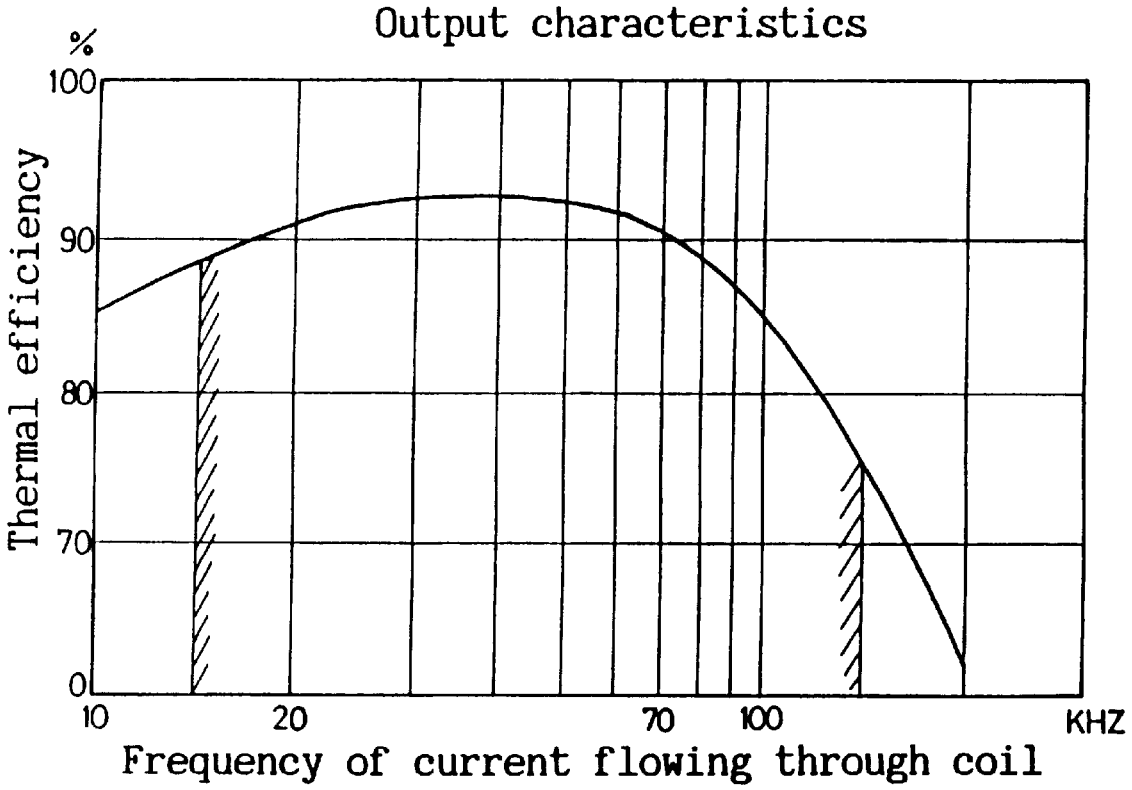

FIG. 13 shows the relationship between frequency and heating efficiency. Using a heating element that is 10 cm in diameter, 50 microns plate thickness, and a corrugation height of 3 mm, the overall heating efficiency was measured as the frequency was changed. The material of construction of the metallic plate was SUS447JI. According to FIG. 13, the heating efficiency gradually decreases over the low frequency region. At the high frequency region, the heating efficiency drops rapidly. A frequency range of 20–70 kHz was found to be advantageous for the maintenance of a high heating efficiency of roughly 90%. However, the frequency range of 15–150 kHz has a possible practical heating efficiency of greater than 70%.

Figure 14:
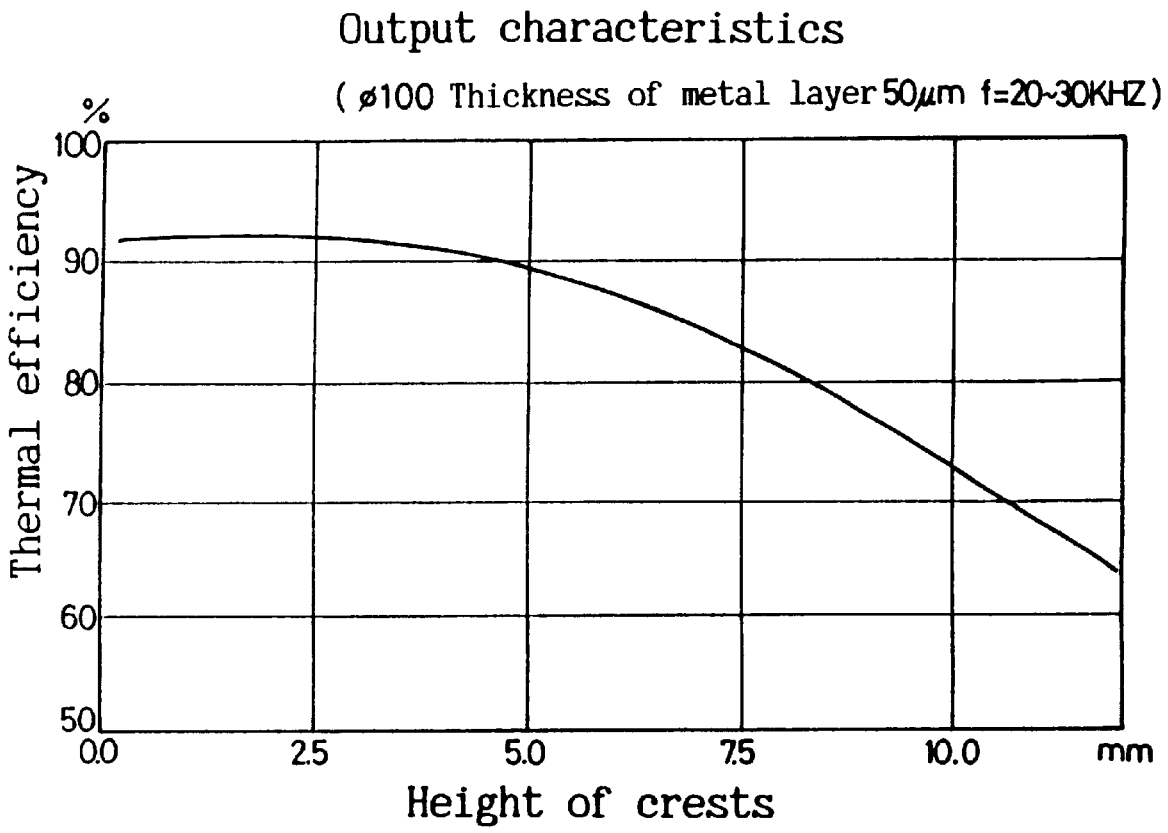
Figure 15:
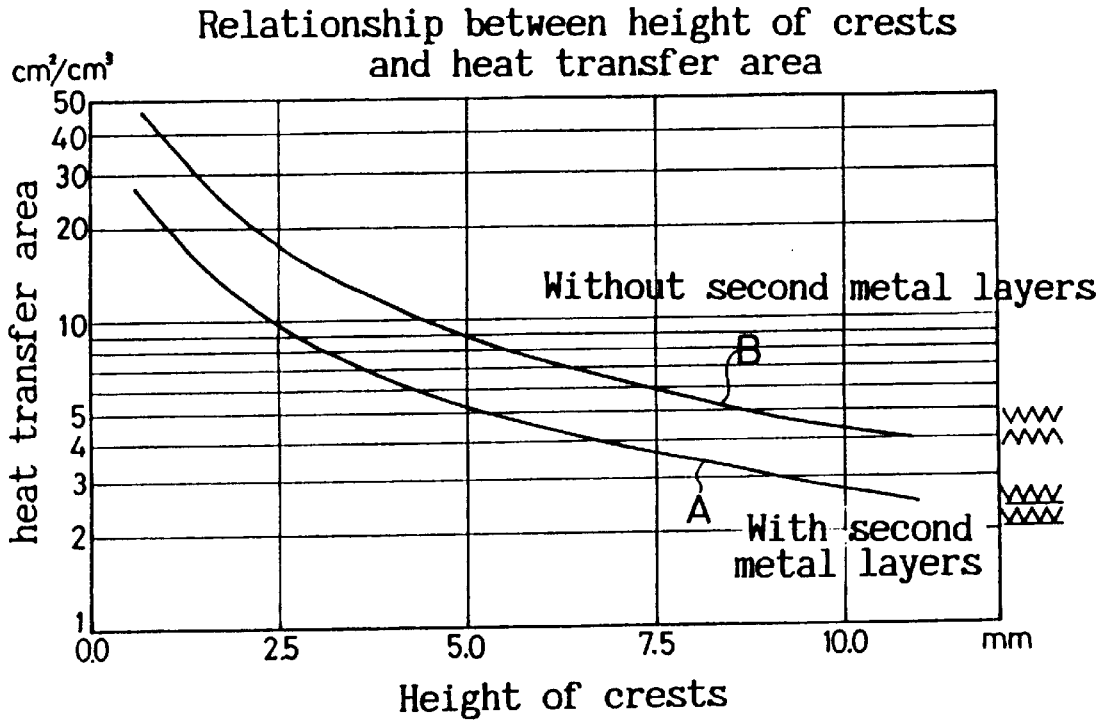
FIG. 15 is a graph that shows the relationship between the heating element heat transfer area and the heating element corrugation height.

FIG. 14 indicates the relationship between the corrugation height and the heating efficiency. The overall heating efficiency was determined using a heating element with 50 micron thick metal plates, varied corrugation height, and a frequency range of 20–30 kHz. The relationship between the corrugation height and the heat transfer area is shown in FIG. 15. The line A in FIG. 15 is that of a no. 2 metallic plate, although in line B in FIG. 15, the no. 2 metallic plate is omitted. As per FIG. 14, that for the practical applications (heating efficiency above 70%) that the corrugation height is 11 mm. Per FIG. 15 line A, the heat transfer area per one cubic centimeter is greater than 2.5 square centimeters. In order to obtain heating efficiency of roughly 90%, the corrugation height should be 5 mm, and it is preferred that the heat transfer area per 1 cubic centimeter should be 5 square centimeters.

Figure 16:
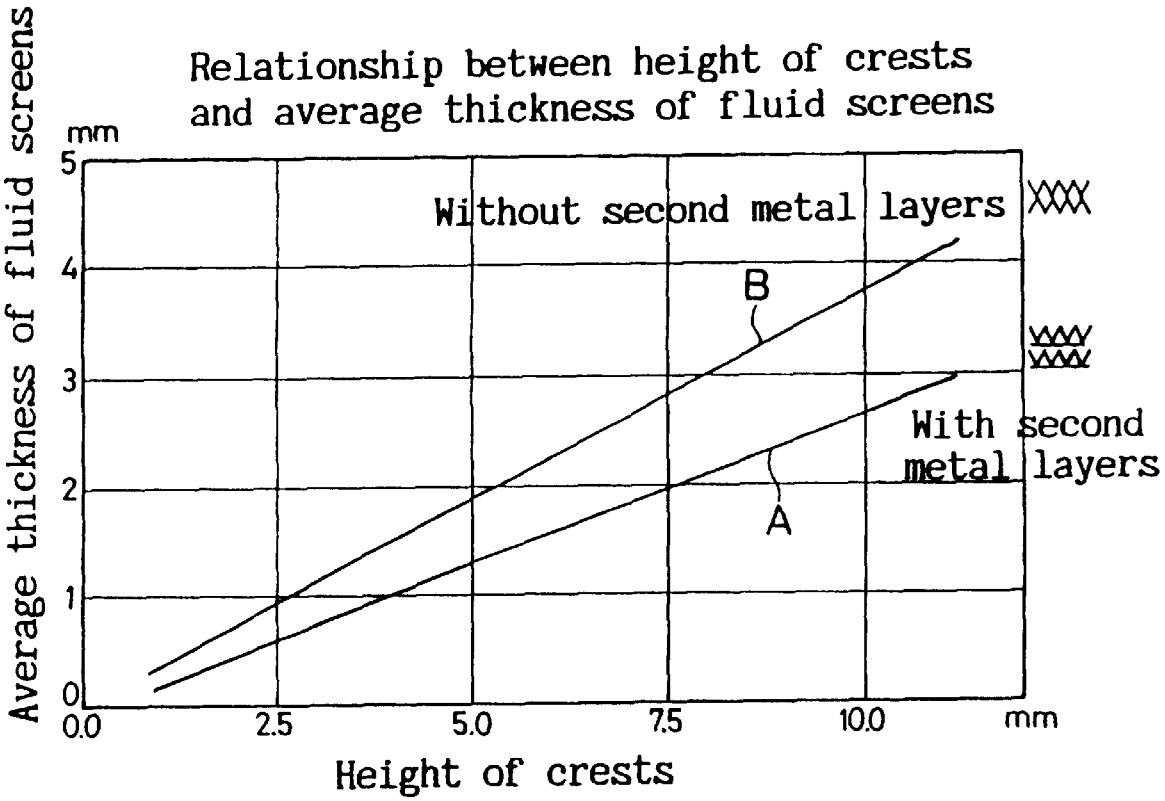
FIG. 16 is a graph that shows the relationship between the heating element corrugation height and the heating element water film thickness.

FIG. 16 shows the relationship between corrugation height and the water film thickness. The average water film thickness was studied using a heating element that had a 10 cm diameter and 50 micron plate thickness, using varied corrugation heights. Line A in FIG. 16 has a no. 2 metallic plate, but in line B of FIG. 16, the no. 2 metallic plate is omitted. Less than 8 mm of water film thickness was used to obtain a heating efficiency above 70%. At a heat transfer area of one square centimeter for the heating element, this is equivalent to a quantity of 0.4 cubic centimeters of fluid being heated. However, in order to secure rapid heating and high responses, it was found that the preferred water film thickness should be less than 1 mm. This is equivalent to 1 cubic centimeter of fluid to be heated per 1 cubic centimeter of heat transfer area of the heating element.

An embodiment of the invention is explained below as a distillation tower using the electromagnetic induction fluid heating apparatus, as shown in FIG. 17. FIG. 17 (*a*) is a traditional example, using an electrical heater and a heat exchanger. FIG. 17 (*b*) is an example of this invention. In FIG. 17 (*b*), kettle 302 is at the bottom part of the distillation tower 301, and pipeline 304 is provided for removal of distilled fluid 303 stored in kettle 302, changing it into steam, and returning it to the upper part of kettle 302. the above-mentioned primary apparatus 1 is attached to this pipeline 301. Steam removed from he upper part of the distillation tower, via pipeline 305, is condensed into liquid by condenser 306, and is stored in tank 308.

In the traditional example of FIG. 17 (*a*), heat exchanger 310, which carries out heat exchange with heating oil, is connected to pipeline 304. Electrical heater 311 heats the heating oil used by heat exchanger 310, and a circulation pump 312 circulates the heater oil.

As shown in FIG. 17 (*b*), when the newly designed primary apparatus 1 is connected to pipeline 304 and when the invertor is used for heating, the response time is rapid and the apparatus weight becomes lighter, since the distilled liquid is directly immersed in the heating element during heating. For example, when used as a 14 kW-class heating device, this results in a combination of electric heater, heater oil, and heat exchanger that yields a response time of about one hour, and the apparatus total weight reaches 6000 kg. However, when the novel primary apparatus 1 is used, response time is about 30–40 seconds, and the total weight of the apparatus becomes 20 kgs.

What is claimed is:

1. An electromagnetic induction fluid heating apparatus comprising:

a heating element made of electrical conductive material and installed in a fluid flow passage, said heating element comprising a plurality of laminated corrugated metallic plates arranged to allow electrical current transmission, wherein ridges and troughs of said corrugated metallic plates form an angle $\alpha$ with respect to a central axis and wherein adjacent corrugated metallic plates are arranged so that the ridges and troughs thereof may cooperate, a coil installed around said heating element, said heating element having a heat transfer area of at least 2.5 square centimeters per cubic centimeter and an amount of said fluid to be heated by one square centimeter of said heat transfer area of said heating element being no more than 0.4 cubic centimeters; and a high-frequency electrical current generator arranged to supply current to said coil, said high-frequency generator comprising an inverter which generates high-frequency electrical current by switching action of semiconductor power devices; and wherein each of said metallic plates has a thickness of at least 30 microns, and a frequency generated by said high-frequency generator falls within a range between 15 and 150kHz.

2. The electromagnetic induction fluid heating apparatus as defined in claim 1, wherein an amount of said fluid to be heated by one square centimeter of said heat transfer area of said heating element is no more than 0.1 cubic centimeters.

3. The electromagnetic induction fluid heating apparatus as defined in claim 1, wherein a plurality of flat second metallic plates are respectively inserted among said corrugated metallic plates so as to allow the electrical current transmission, and wherein apertures are provided within said corrugated metallic plates and said flat second metallic plates.

4. The electromagnetic induction fluid heating apparatus as defined in claim 1, wherein the current generator comprises:

four semiconductor power devices connected in a full-bridge configuration, two of said four semiconductor power devices being actuated by reference pulses and the remaining two of said semiconductor power devices being actuated by control pulses; and a phase shift controller for adjusting a phase difference between said reference pulses and said control pulses.

5. The electromagnetic induction fluid heating apparatus as defined in claim 4, further comprising a temperature sensor arranged to sense fluid temperature and a temperature controller responsive to the temperature sensor for controlling the phase shift controller.

6. The electromagnetic induction fluid heating apparatus as defined in claim 5, wherein said temperature controller is a PID controller having at least two degrees of freedom.

7. The electromagnetic induction fluid heating apparatus as defined in claim 4, wherein said semiconductor power devices comprise a static induction transistor (SIT).

8. The electromagnetic induction fluid heating apparatus as defined in claim 4, wherein said semiconductor power devices comprise a B-SIT.

9. The electromagnetic induction fluid heating apparatus as defined in claim 4, wherein said semiconductor power devices comprise a MOSFET.

10. The electromagnetic induction fluid heating apparatus as defined in claim 4, wherein said semiconductor power devices comprise an IGBT.

11. The electromagnetic induction fluid heating apparatus as defined in claim 4, wherein said semiconductor power devices comprise a MCT.

12. The electromagnetic induction fluid heating apparatus as defined in claim 1, wherein said high-frequency generator includes a resonance capacitor connected in series with said coil.

13. The electromagnetic induction fluid heating apparatus according to claim 1 wherein said generated frequency falls within a range between 20 and 70 kHz.

14. A method of heating fluid using a heating element made by laminating a plurality of corrugated metallic plates so as to allow electrical current transmission, ridges and troughs of said corrugated first metallic plate forming an angle $\alpha$ with respect to a central axis and adjacent corrugated metallic plates being aligned so that the ridges and troughs thereof may cooperate, each metallic plate having a thickness of at least 30 microns and a coil installed around said heating element, said heating element having a heat transfer area of at least 2.5 square centimeters per cubic centimeter, comprising:

generating a high-frequency current within a range between 15 and 150 kHz using semiconductor power devices;

applying the high-frequency current to the coil so as to generate heat by inducing eddy currents in substantially the whole heating element; and heating the fluid using said generated heat, wherein said fluid amount to be heated by one square centimeter of said heat transfer area of said heating element is no more than 0.4 cubic centimeters.

15. The method of heating according to claim 14, wherein said high frequency current is within a range between 20 and 70 kHz.

16. The method of heating according to claim 14, wherein said fluid amount to be heated by one square centimeter of said heat transfer area of said heating element is no more than 0.1 cubic centimeters.

17. A method of heating fluid with a heating element constructed by alternately laminating a plurality of corrugated first metallic plates and a plurality of flat second metallic troughs of said corrugated first metallic plate forming an angle $\alpha$ with respect to a central axis and adjacent corrugated first metallic plates being aligned so that the ridges and troughs thereof may cooperate, apertures being provided within each of the metallic plates, each metallic plate having a thickness of at least 30 microns, and a coil being installed around said heating element, wherein said heating element has a heat transfer area of at least 2.5 square centimeters per cubic centimeter, the method comprising:

generating a high-frequency current within a range between 15 and 150 kHz using semiconductor power devices;

applying the high-frequency current to the coil so as to generate heat by inducing eddy currents in substantially the whole heating element; and heating the fluid using said generated heat, wherein said fluid amount to be heated by one square centimeter of said heat transfer area of said heating element is no more than 0.4 cubic centimeters.

18. The method of heating according to claim 17, wherein said high frequency current is within a range between 20 and 70 kHz.

19. The method of heating according to claim 17, wherein said fluid amount to be heated by one square centimeter of said heat transfer area of said heating element is no more than 0.1 cubic centimeters.

* * * * *